US012017104B2

(12) United States Patent
Synenkyj et al.

(10) Patent No.: US 12,017,104 B2
(45) Date of Patent: Jun. 25, 2024

(54) VERTICAL ABDOMINAL CORE STABILIZATION EXERCISER

(71) Applicant: Vertical Plank LLC, Brook Park, OH (US)

(72) Inventors: Paul Synenkyj, Brook Park, OH (US); Joe Spalding, Elyria, OH (US); Matt Ivers, Strongsville, OH (US); Russell Craig, Marion, OH (US)

(73) Assignee: Vertical Plank LLC, Brook Park, OH (US)

( * ) Notice: Subject to any disclaimer, the term of this patent is extended or adjusted under 35 U.S.C. 154(b) by 108 days.

(21) Appl. No.: 17/497,418

(22) Filed: Oct. 8, 2021

(65) Prior Publication Data

US 2022/0032104 A1 Feb. 3, 2022

Related U.S. Application Data

(63) Continuation-in-part of application No. 16/598,763, filed on Oct. 10, 2019, now abandoned.
(Continued)

(51) Int. Cl.
*A63B 21/00* (2006.01)
*A63B 21/068* (2006.01)
*A63B 23/02* (2006.01)

(52) U.S. Cl.
CPC ..... *A63B 21/00047* (2013.01); *A63B 21/068* (2013.01); *A63B 23/0205* (2013.01); *A63B 2208/029* (2013.01)

(58) Field of Classification Search
CPC . A63B 21/00047; A63B 21/068; A63B 21/00; A63B 21/0005; A63B 21/00054; A63B 21/002; A63B 21/0023; A63B 21/04; A63B 21/0407; A63B 21/05; A63B 21/045; A63B 21/0455; A63B 21/062; A63B 21/0622; A63B 21/0624; A63B 21/0626; A63B 21/0628; A63B 21/063; A63B 21/0632; A63B 21/078; A63B 2208/029; A63B 23/0205; A61H 3/04
(Continued)

(56) References Cited

U.S. PATENT DOCUMENTS 1,495,536 A * 5/1924 Smith ..... A63B 1/00 D21/797
2,666,640 A * 1/1954 Jennings, Sr. ..... A63B 3/00 482/141

(Continued)

*Primary Examiner* — Megan Anderson
(74) *Attorney, Agent, or Firm* — Renner, Otto, Boisselle, & Sklar, LLP

(57) ABSTRACT

An exercise device includes a lower base and an upper platform with a support frame extending angularly therebetween. The angularly extending support frame extends between the lower base and the upper platform at an angle sufficient to allow for a user to position their body in a generally vertical plank position and hold their body in a straight line, angled relative to the floor between approximately 85 degrees to approximately 75 degrees. An exercise system may include a discrete upper platform and a discrete lower plank positioning platform, each of which are removably mountable to a support frame. The support frame, for example, may be a part of another exercise device or may be a discrete stand-alone support frame specifically configured for exercise system.

20 Claims, 6 Drawing Sheets

Related U.S. Application Data

(60) Provisional application No. 62/744,371, filed on Oct. 11, 2018.

(58) Field of Classification Search
USPC ..... 482/91
See application file for complete search history.

(56) References Cited

U.S. PATENT DOCUMENTS 3,394,933 A * 7/1968 Benoit ..... A61H 3/04 482/67
4,456,246 A * 6/1984 Szabo ..... A63B 21/06 482/99
5,118,101 A * 6/1992 Belli ..... A63B 5/00 482/52
5,702,326 A * 12/1997 Renteria ..... A61H 3/04 482/68
6,217,483 B1 * 4/2001 Kallassy ..... A63B 21/068 482/41
6,343,802 B1 * 2/2002 Workman ..... A61H 3/008 482/68
8,366,590 B2 * 2/2013 Atnafe ..... A63B 22/0058 482/52
9,446,282 B2 9/2016 Thorpe
9,579,535 B2 * 2/2017 Markowitz ..... A63B 21/0557
9,592,419 B1 3/2017 Cuffe
9,895,564 B1 * 2/2018 Katz ..... A63B 23/0211
9,895,573 B2 2/2018 Domesick
10,080,701 B1 * 9/2018 Bagheri ..... A61H 3/008
10,137,326 B2 11/2018 Thorpe
10,286,245 B2 5/2019 Domesick
10,357,675 B1 * 7/2019 Katz ..... A63B 21/068
10,449,416 B2 * 10/2019 Dalebout ..... A63B 22/02
10,556,142 B2 2/2020 Stein
10,688,335 B1 * 6/2020 Maher ..... A63B 24/0087
2004/0209752 A1 * 10/2004 Thonn, Jr. ..... A63B 21/4047 482/123
2007/0194547 A1 * 8/2007 Steiner ..... A61H 3/04 280/87.021
2009/0215594 A1 * 8/2009 Panaiotov ..... A63B 21/16 482/130
2010/0022367 A1 * 1/2010 Mcbride ..... A63B 23/0216 482/140
2010/0041531 A1 * 2/2010 Rochford ..... A63B 21/04 482/148
2010/0048368 A1 * 2/2010 Donofrio ..... A63B 21/0552 482/130
2010/0152005 A1 * 6/2010 Mehta ..... A63B 22/14 482/142
2011/0195822 A1 * 8/2011 Donofrio ..... A63B 1/00 482/129
2012/0010058 A1 1/2012 Sprague
2014/0011648 A1 1/2014 Carney
2014/0011649 A1 1/2014 Carney
2014/0018215 A1 * 1/2014 Donofrio ..... A63B 21/169 482/129
2014/0031182 A1 * 1/2014 Donofrio ..... A63B 21/0552 482/129
2014/0135183 A1 * 5/2014 Inglut ..... A63B 23/1227 482/96
2014/0274607 A1 * 9/2014 Kaye ..... A63B 23/03508 482/130
2016/0199691 A1 * 7/2016 Hockridge ..... A63B 23/1227 482/96
2016/0263425 A1 * 9/2016 Carney ..... A63B 23/03575
2016/0346581 A1 * 12/2016 Splane, Jr. ..... A63B 21/4033
2017/0014666 A1 * 1/2017 Sather ..... A63B 21/4049
2017/0120099 A1 * 5/2017 Biddix, Jr. ..... A63B 23/1218
2017/0144008 A1 * 5/2017 Brown ..... A63B 3/00
2017/0157450 A1 * 6/2017 Anderson ..... A63B 1/00
2017/0340916 A1 * 11/2017 Gennusa ..... A63B 1/00
2018/0064981 A1 * 3/2018 Domesick ..... A63B 21/0023
2018/0085622 A1 * 3/2018 Ivan ..... A63B 21/1636
2018/0085623 A1 * 3/2018 Flook ..... A63B 21/0557
2018/0221700 A1 * 8/2018 George ..... A63B 23/0355
2019/0060153 A1 * 2/2019 Mangino, Jr. ..... A61H 15/00
2019/0224031 A1 * 7/2019 Dunca ..... A63B 21/0421
2019/0321251 A1 * 10/2019 Chen ..... A61H 3/008
2019/0321678 A1 * 10/2019 Domesick ..... A63B 23/02
2019/0351279 A1 * 11/2019 Carney ..... A63B 21/0442
2019/0351284 A1 * 11/2019 Carney ..... A63B 21/4035
2019/0358114 A1 * 11/2019 Roth ..... A61H 3/04
2020/0078633 A1 * 3/2020 Chou ..... A63B 21/00069
2020/0289884 A1 * 9/2020 Davide ..... A63B 21/4035
2021/0260432 A1 * 8/2021 Thomas ..... A63B 21/0023

* cited by examiner

VERTICAL ABDOMINAL CORE STABILIZATION EXERCISER

This application is a Continuation-in-part and claims priority of U.S. application Ser. No. 16/598,763, filed Oct. 10, 2019, which claims priority of U.S. Application No. 62/744,371, filed Oct. 11, 2018, the entire disclosures of which are hereby incorporated by reference.

TECHNICAL FIELD

The present disclosure relates generally to exercise equipment and more particularly to an exercise device and system to aid in abdominal core muscle training.

BACKGROUND

The plank exercise is a popular exercise that is intended to work the core musculature (e.g. upper and/or lower body muscle(s), abdominal muscle(s), back muscle(s), hip muscle(s), gluteal muscle(s), etc.) of the body. Strengthening the core musculature not only provides additional support to the spine, thereby aiding ideal posture, but improves the performance of other exercises. The plank exercise is generally defined as a static exercise where an individual uses his or her arms to raise the individual's body off of the floor and holds the body straight and firm in a generally horizontal position relative to the floor, engaging the core musculature to do so.

Typically, the plank exercise is performed without any equipment, and is commonly performed on the ground where the hands and/or a portion of the arms (such as the forearms, elbows, etc.) are placed on the ground with the body in a prone position. The shoulders are typically positioned in line with the elbows, and the rest of the body is stiffened by contracting the core musculature such that they body forms a substantially straight horizontal line from the shoulders all the way down to the feet, which are supporting the other end of the body by resting on the ground (e.g., the toes are on the ground, the feet are on the ground, the individual is supported by the balls of his or her feet, with feet hip-distance apart, with feet together, the heels are on the ground when performing a reverse planking exercise, etc.).

SUMMARY

The inventors have found that facilitating a similar plank type exercise in a generally vertical condition improves, inter alia, greater muscle activation and blood lactate and force production. Accordingly, a device and system for facilitating a vertical plank exercise is described herein.

An exercise device may generally include a lower base for supporting the exercise device on a floor, an upper support for suspending a user on the exercise device above the floor, and a plank positioner for supporting the user at an acute angle relative to the floor so as to be in the vertical plank position. For example, the exercise device may include a lower base and an upper platform with a support frame extending angularly therebetween. The angularly extending support frame extends between the lower base and the upper platform at an angle sufficient to allow for a user to position their body in a generally vertical plank position and hold their body in a straight line. Alternatively, an exercise system may include a discrete upper platform and a discrete lower plank positioning platform, each of which are removably mountable to a support frame. The support frame, for example, may be a part of another exercise device or may be a discrete stand-alone support frame specifically configured for exercise system.

According to an aspect of this disclosure, an exercise device for facilitating a user in holding a vertical plank position on the exercise device includes a lower base configured to support the exercise device on the floor. The exercise device also includes an upper support disposed above the lower base and configured to suspend the user on the exercise device above the floor. The exercise device also includes a plank positioner disposed between the lower base and the upper support. The plank positioner is configured to support the user at an acute angle relative to the floor.

According to an embodiment of any paragraph(s) of this summary, the acute angle may be in the range of 60 degrees to 89 degrees.

According to an aspect of this disclosure, an exercise device for facilitating a user in holding a vertical plank position on the exercise device includes a lower base formed of a pair of lower parallel joists, an upper platform formed of a pair of upper parallel joists, and an angularly disposed upward support frame formed of a pair of parallel connecting struts fixed to and extending between the pair of lower parallel joists of the lower base and the pair of upper parallel joists of the upper platform. The angularly disposed upward support includes a plank positioning plate fixed to and extending between the pair of parallel connecting struts.

According to an embodiment of any paragraph(s) of this summary, the pair of parallel connecting struts of the angularly disposed upward support frame extend from the pair of lower parallel joists and the pair of upper parallel joists at an angle in the range of 60 degrees to 89 degrees.

According to an embodiment of any paragraph(s) of this summary, the lower base includes at least one handling bar fixed to the pair of lower parallel joists.

According to an embodiment of any paragraph(s) of this summary, the upper platform includes at least one mounting bar fixed to the pair of upper parallel joists.

According to an embodiment of any paragraph(s) of this summary, the upper platform includes at least one stabilizing bar fixed to the pair of upper parallel joists.

According to an embodiment of any paragraph(s) of this summary, the upper platform includes a plurality of arm pads, each fixed to a respective one of the upper parallel joists.

According to an embodiment of any paragraph(s) of this summary, the lower base includes at least one lower transverse joist fixed to and extending between the pair of lower parallel joists.

According to an embodiment of any paragraph(s) of this summary, the upper platform includes at least one upper transverse joist fixed to and extending between the pair of upper parallel joists.

According to an embodiment of any paragraph(s) of this summary, the angularly disposed upward support includes at least one supporting transverse joist fixed to and extending between the pair of connecting struts.

According to another aspect of this disclosure, an exercise system for facilitating a user in holding a vertical plank position on the exercise system includes an upper platform configured to be removably mountable on a support frame, and a lower plank positioning platform configured to be removably mountable on the support frame below the upper platform.

According to an embodiment of any paragraph(s) of this summary, the upper platform includes a pair of upper parallel joists adjustably spaced apart and supported by an upper transverse joist. The upper platform additionally includes an upper mounting bracket and an upper mounting bracket arm fixed to and extending between the upper mounting bracket and the upper transverse joist.

According to an embodiment of any paragraph(s) of this summary, the upper platform includes at least one mounting bar fixed to the pair of upper parallel joists and at least one stabilizing bar fixed to the pair of upper parallel joists.

According to an embodiment of any paragraph(s) of this summary, the upper platform includes a plurality of arm pads, each fixed to a respective one of the upper parallel joists.

According to an embodiment of any paragraph(s) of this summary, the lower plank positioning platform includes a plank positioning plate, a lower mounting bracket, and a lower mounting bracket arm fixed to and extending between the lower mounting bracket and the plank positioning plate.

According to an embodiment of any paragraph(s) of this summary, the plank positioning plate includes at least one handling bar fixed to the plank positioning plate.

According to an embodiment of any paragraph(s) of this summary, the plank positioning plate is configured to be angled relative to the support frame at an angle in the range of 60 degrees to 89 degrees.

According to an embodiment of any paragraph(s) of this summary, the plank positioning plate includes a flange at a bottom edge thereof, and the lower plank positioning platform includes a foot pad disposed on a bottom surface of the flange.

According to another aspect of this disclosure, an exercise system for facilitating a user in holding a vertical plank position on the exercise system includes a support frame, an upper platform configured to be removably mountable on the support frame, and a lower plank positioning platform configured to be removably mountable on the support frame below the upper platform.

According to an embodiment of any paragraph(s) of this summary, the support frame is a discrete stand-alone support frame.

According to an embodiment of any paragraph(s) of this summary, the support frame is part of an exercise device.

According to another aspect of this disclosure, a method of performing a vertical plank exercise on an exercise device includes a step of mounting the exercise device so as to suspend a user's body above a floor. The method also includes a step of positioning the user's body at an acute angle relative to the floor with the use of a plank positioner.

According to an embodiment of any paragraph(s) of this summary, the step of mounting the exercise device may include supporting at least one arm of the user on an upper support of the exercise device.

According to an embodiment of any paragraph(s) of this summary, the step of positioning the user's body includes supporting at least one leg of the user with the plank positioner such that the user's body is positioned at the acute angle.

The following description and the annexed drawings set forth in detail certain illustrative embodiments described in this disclosure. These embodiments are indicative, however, of but a few of the various ways in which the principles of this disclosure may be employed. Other objects, advantages and novel features will become apparent from the following detailed description when considered in conjunction with the drawings.

BRIEF DESCRIPTION OF DRAWINGS

The annexed drawings show various aspects of the disclosure.

DETAILED DESCRIPTION

Figure 1:
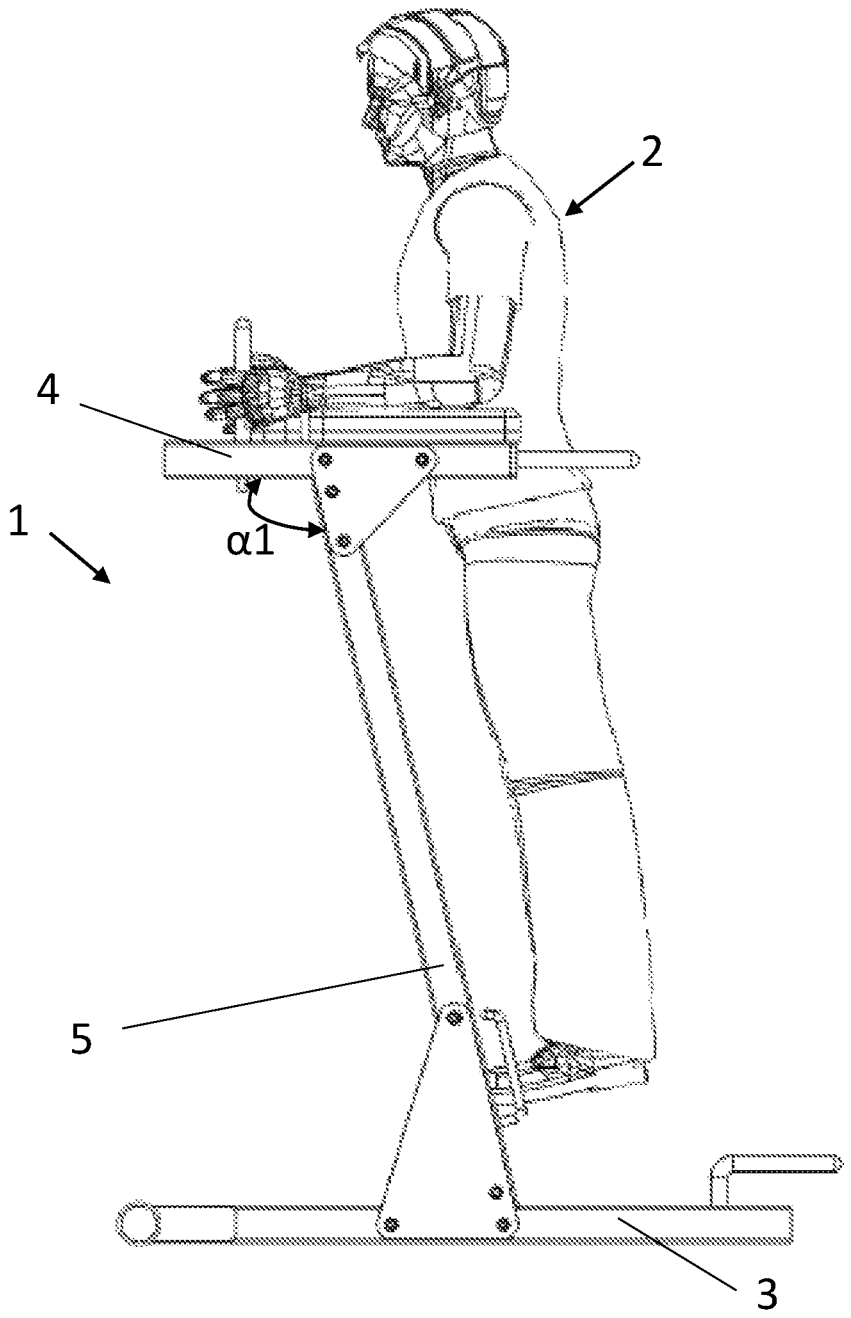
FIG. 1 is a side view of an exercise device with a user thereon in a vertical plank position.

With reference to FIG. 1, an exercise device 1 is depicted. The exercise device 1 is configured to facilitate a user 2 in holding a vertical plank position on the exercise device 1. Specifically, the exercise device 1 includes a lower base 3 configured to support the exercise device 1 on a floor. The exercise device 1 also includes an upper support 4 disposed above the lower base 3. The upper support 4 is configured to suspend the user 2 on the exercise device 1 above the floor. For example, as depicted, the upper support 4 may be configured to support one or more arms of the user 2 such that the rest of the user's body hangs from the upper support 4 above the floor, with a force of gravity causing the user's body to be suspended generally vertically relative to the floor. The exercise device 1, however, also includes a plank positioner 5 disposed between the lower base 3 and the upper support 4 which is configured to support the user at an acute angle relative to the floor. For example, the plank positioner 5 may be configured to support one or more foot of the user, or one or more knee of the user, such that the user's body is aligned at an acute angle $\alpha 1$ relative to the floor, instead of being suspended exactly perpendicular to the floor. This position is referred to herein as the "vertical plank position". The acute angle $\alpha 1$ may be in the range of, for example, 60 degrees to 89 degrees, 65 degrees to 88 degrees, 70 degrees to 87 degrees, or 75 degrees to 85 degrees. The exercise device 1 is therefore configured to cause the user to engage their core musculature in order to hold the vertical plank position on the exercise device 1.

Figure 2:
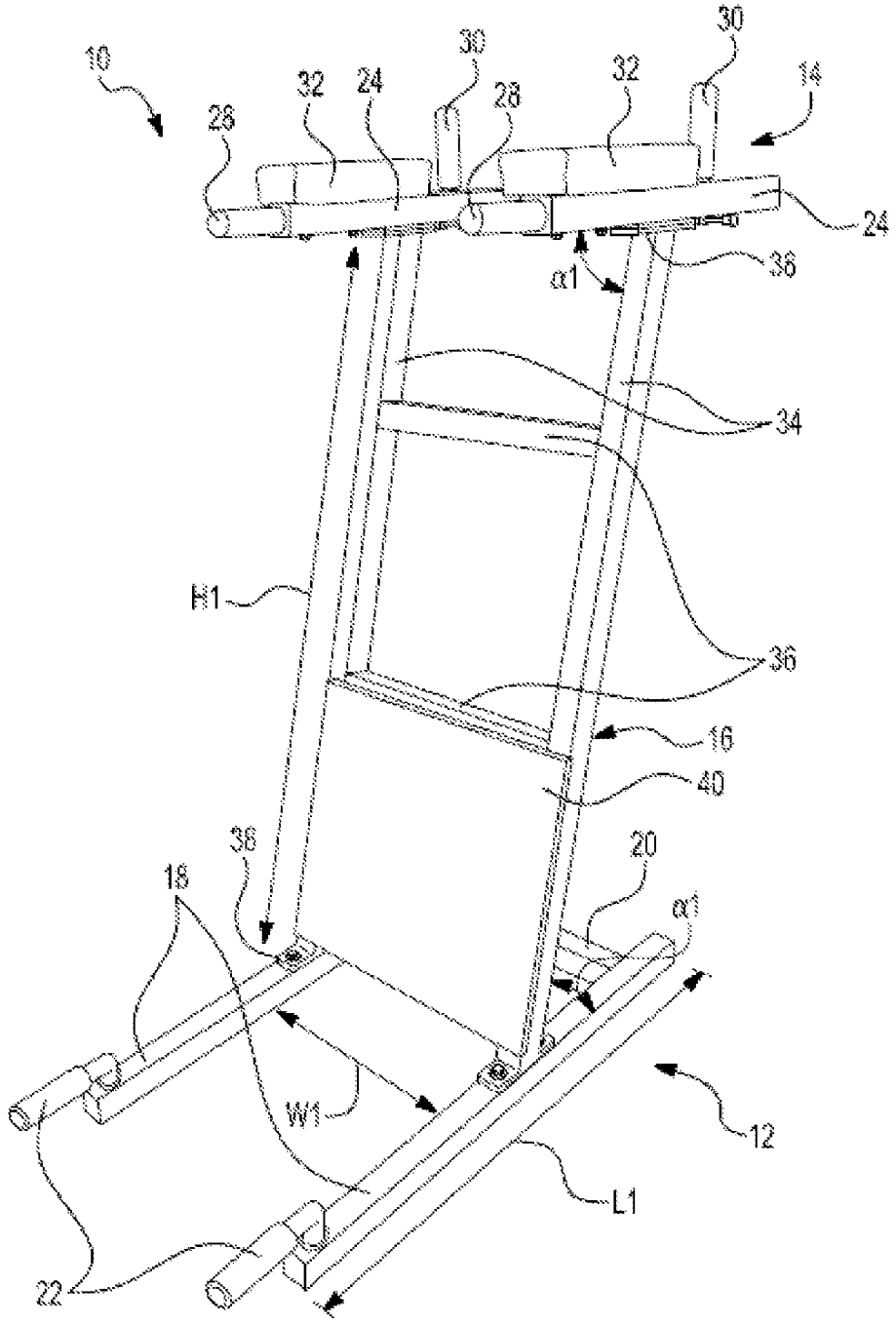
FIG. 2 is a perspective view of an exercise device.

With reference to FIGS. 2 and 23 a vertical core exercise device 10 for facilitating a user in performing a vertical plank exercise is depicted. The exercise device 10 includes a lower base 12, an upper platform 14, and an angularly disposed upward support frame 16 fixed to and extending between the lower base 12 and the upper platform 14. The lower base 12 provides a generally horizontal stabilization of the exercise device 10 at a lowermost end of the exercise device 10 and the upper platform 14 provides a generally horizontal stabilization of the exercise device 10 at an uppermost end of the exercise device 10. The support frame 16 is angularly affixed to and extending between the lower base 12 and the upper platform 14 in a stable manner.

The lower base 12 may be formed of a pair of lower parallel joists 18 spaced apart from each other by a width W1. The width W1, for example, may be in the range of 25.40 centimeters (10 inches) to 76.20 centimeters (30 inches), 30.48 centimeters (12 inches) to 68.58 centimeters (27 inches), or 38.10 centimeters (15 inches) to 60.96 centimeters (24 inches). The width W1 may be adjustable to other widths. The lower parallel joists 18 may have an overall length L1 of sufficient size to support the exercise device 10 and a user during a typical operation of the exercise device 10, which will be described in greater detail below. The length L1, for example, may be in the range of 50.80 centimeters (20 inches) to 177.80 centimeters (70 inches), 63.50 centimeters (25 inches) to 165.10 centimeters (65 inches), or 76.20 centimeters (30 inches) to 152.40 centimeters (60 inches). The length L1 may be adjustable to other lengths. The lower parallel joists 18 may be spaced apart and supported by a lower transverse joist 20 fixed to and extending between the lower parallel joists 18. A length of the lower transverse joist 20, therefore, may be equal to the width W1 of which the lower parallel joists 18 are spaced apart. The lower transverse joist 20 may be fixed to each of the lower parallel joists 18 by welding. However, it is understood that the lower transverse joist 20 may be fixed to each of the lower parallel joists 18 with any other suitable fixing means, such as screws or bolts. The lower transverse joist 20 may be fixed to each of the lower parallel joists 18 at any point along the length L1 of the lower parallel joists 18 and may extend between the lower parallel joists 18 at any angle. In the depicted embodiment, for example, the lower transverse joist 20 is fixed to each of the lower parallel joists 18 at or near an end thereof and extends between the lower parallel joists 18 generally perpendicular to each of the lower parallel joists 18. The lower parallel joists 18 and the lower transverse joist 20 are described herein as non-limiting examples, and it is understood that other supporting members other than joists may be used with the exercise device 10 described herein.

The lower base 12 may additionally include at least one handling bar 22 fixed to the lower base 12 and configured to assist a user in handling or moving the lower base 12 of the exercise device 10. As depicted, the at least one handling bar 22 includes two handling bars 22, each fixed to one of the lower parallel joists 18 at or near an end thereof and cantilevered from the respective ends of the lower parallel joists 18, extending parallel therewith. However, it is understood that the at least one handling bar 22 may include one handling bar 22 or more than two handling bars 22 and may be fixed to any other part of the lower base 12, such as for example another position on the lower parallel joists 18 or on the lower transverse joist 20. The at least one handling bar 22 may also be configured to be used as grasping points for a user to perform various other exercises, such as push-ups or exercises using resistance bands, on the exercise device 10.

The lower base 12, including the lower parallel joists 18, the lower transverse joist 20, and the at least one handling bar 22 may be formed of tubular or angular steel or aluminum members. However, it is understood that such materials and constructions should be considered merely exemplary and may be alternately substituted within a broad range of functional equivalents. The at least one handling bar 22 may include a cover or coating on at least a part of the at least one handling bar 22 configured to make handling or moving the lower base 12 more comfortable for a user when engaging the at least one handling bar 22. The cover or coating may be made of, for example, rubber, foam, fabric, leather, or any other suitable material configured to promote comfortable handling of the at least one handling bar 22.

The upper platform 14 may be formed by a pair of upper parallel joists 24 spaced apart by the same width W1 that the lower parallel joists 18 are spaced apart. The upper parallel joists 24 may also have the same overall length L1 as the lower parallel joists 18, but may be offset from the lower parallel joists 18 such that the upper parallel joists 24 are not disposed directly above and aligned with the lower parallel joists 18. It is understood, however, that the upper parallel joists 24 may alternatively have different dimensions than the lower parallel joists 18 that are still sufficient to support a user during a typical operation of the exercise device 10, which will be described in greater detail below.

The upper parallel joists 24 may be spaced apart and supported by an upper transverse joist 26 fixed to and extending between the upper parallel joists 24. A length of the upper transverse joist 26, therefore, may be equal to the width W1 of which the upper parallel joists 24 are spaced apart. The upper transverse joist 26 may be fixed to each of the lower parallel joists 24 by welding. However, it is understood that the upper transverse joist 26 may be fixed to each of the upper parallel joists 24 with any other suitable fixing means, such as screws or bolts. The upper transverse joist 26 may be fixed to each of the upper parallel joists 24 at or near an end thereof and may extend between the upper parallel joists 24 at any angle. In the depicted embodiment, for example, the upper transverse joist 26 extends between the upper parallel joists 24 generally perpendicular to each of the upper parallel joists 24. The upper parallel joists 24 and the upper transverse joist 26 are described herein as non-limiting examples, and it is understood that other supporting members other than joists may be used with the exercise device 10 described herein.

The upper platform 14 may include at least one mounting bar 28 and at least one stabilizing bar 30, each fixed to the upper platform 14 and configured to assist the user in mounting the exercise device 10 and stabilizing themselves on the exercise device 10, respectively. As depicted, the at least one mounting bar 28 includes two mounting bars 28, each fixed to one of the upper parallel joists 24 at a first end thereof and extending out from the end of each of the upper parallel joists 24. For example, the at least one mounting bar 28 may extend out from the first end of each of the upper parallel joists 24 such that they are cantilevered from the upper parallel joists 24 in a direction parallel to each of the upper parallel joists 24. In this way, a user can grasp the at least one mounting bar 28 to hoist themselves up onto the exercise device 10. Once hoisted up, the user may grasp the at least one stabilizing bar 30 to position themselves appropriately on the exercise device 10 and stabilize themselves thereon. The at least one mounting bar 28 may additionally be configured to be used as grasping points for a user to perform various other exercises, such as tricep dips, on the exercise device 10.

As depicted, the at least one stabilizing bar 30 includes two stabilizing bars 30, each fixed to one of the upper parallel joists 24 at or near a second end thereof and extending out from each of the upper parallel joists 24. For example, the at least one stabilizing bar 30 may extend out from each of the upper parallel joists 24 at an angle that is not parallel to each of the upper parallel joists 24. As depicted, the at least one stabilizing bar may extend out from each of the upper parallel joists 24 generally perpendicular to each of the upper parallel joists 24. In this way, the user can grasp the at least one stabilizing bar 30 to comfortably stabilize themselves on the exercise device 10 once mounted. The at least one stabilizing bar 30 may be repositionable on each of the upper parallel joists 24 so as to enable appropriate and comfortable grasping by a variety of users when they are mounted on the exercise device 10. Additionally, the at least one stabilizing bar 30 may be repositionable on another one of the upper parallel joists 24 so that more than one stabilizing bar 30 may be fixed to the same upper parallel joist 24. It is understood that the above-described positioning and orientation of the at least one mounting bar 28 and the at least one stabilizing bar 30 are described as non-limiting examples, and that other suitable arrangements may be suitable for the exercise device 10.

The upper platform 14 may additionally include a plurality of arm pads 32. For example, at least one of the plurality of arm pads 32 may be fixed to a respective one of the upper parallel joists 24 between the first and second end thereof. Another one of the plurality of arm pads 32 may be fixed to the upper transverse joist 26. The plurality of arm pads 32 may be removably fixed to the respective upper parallel joists 24 and the upper transverse joist 26, respectively, such that they are repositionable thereon. For example, the plurality of arm pads 32 may be removably fixed to the respective upper parallel joists 24 and the upper transverse joist 26 with a hook and loop fastener, snaps, buttons, screws, bolts, or any other suitable removable fixing means. As depicted, the arm pads 32 that are fixed to the upper parallel joists 24 may be disposed between a respective mounting bar 28 and stabilizing bar 30 of each of the parallel joists 24. In this way, once a user has mounted the exercise device 10 and is stabilized in the appropriate position by grasping the at least one stabilizing bar 30, the user's arms may rest comfortably on the plurality of arm pads 32 for supporting the user's weight on the exercise device 10. The arm pad 32 that is fixed to the upper transverse joist 26 is positioned so that when a user mounts the exercise device 10 and turns 90 degrees to the side, the user's arm may rest comfortably on the arm pad 32 on the upper transverse joist 26, facilitating the user in performing a side plank position. The plurality of arm pads 32 may be made of foam, fabric, leather, or any other suitable material configured to provide padding.

The upper platform 14, including the upper parallel joists 24, the upper transverse joist 26, the at least one mounting bar 28, and the at least one stabilizing bar 30 may be formed of tubular or angular steel members. However, it is understood that such materials and constructions should be considered merely exemplary and may be alternately substituted within a broad range of functional equivalents. The at least one mounting bar 28 and the at least one stabilizing bar 30 may additionally include a cover or coating on at least a part of the at least one mounting bar 28 and the at least one stabilizing bar 30, respectively, similar to the cover or coating on the at least one handling bar 22 previously described. The cover or coating, therefore, may be made of, for example, rubber, foam, fabric, leather, or any other suitable material configured to promote comfortable handling of the at least one mounting bar 28 and the at least one stabilizing bar 30.

The support frame 16, angularly extending between the lower base 12 and the upper platform 14, may be formed by a pair of parallel connecting struts 34, spaced apart from each other by the width W1. Each of the connecting struts 34 are fixed to respective lower parallel joists 18 of the lower base 12 at a lower end thereof and are fixed to respective upper parallel joists 24 of the upper platform 14 at an upper end thereof. The connecting struts 34 may have an overall length H1 of a sufficient size to support a user during a typical operation of the exercise device 10, as will be described in more detail below. For example, the length H1 of the connecting struts 34 may be in the range of 76.20 centimeters (30 inches) to 177.80 centimeters (70 inches), 88.90 centimeters (35 inches) to 165.10 centimeters (65 inches), or 101.60 centimeters (40 inches) to 152.40 centimeters (60 inches).

The connecting struts 34 may be spaced apart and supported by at least one supporting transverse joist 36 fixed to and extending between the connecting struts 34. A length of the at least one supporting transverse joist 36, therefore, may be equal to the width W1 of which the connecting struts 34 are spaced apart. The at least one supporting transverse joist 36 may be fixed to each of the connecting struts 34 by welding. However, it is understood that the at least one supporting transverse joist 36 may be fixed to each of the connecting struts 34 with any other suitable fixing means, such as screws or bolts. The at least one supporting transverse joist 36 may be fixed to each of the connecting struts 34 at any position along the length H1 of the connecting struts 34 and may extend between the upper parallel joists 24 at any angle. In the depicted embodiment, for example, the at least one supporting transverse joist 36 includes two supporting transverse joists 36 each disposed at or near a respective upper and lower end of the connecting struts and extending between the connecting struts 34 generally perpendicular to each of the connecting struts 34. The supporting transverse joist 36 is described herein as a non-limiting example, and it is understood that another supporting member other than a joist may be used with the exercise device 10 described herein. Alternatively, the exercise device 10 may not include a supporting transverse joist 36 whatsoever.

The upper and lower ends of each of the connecting struts 34 may be fixed to the respective lower parallel joists 18 and upper parallel joists 24 by welding. However, it is understood that the upper and lower ends of each of the connecting struts 34 may be fixed to the respective lower parallel joists 18 with any other suitable fixing means, such as screws or bolts. The upper and lower ends of each of the connecting struts 34 may therefore include respective mounting flanges 38 through which the screws or bolts may pass to fix the connecting struts 34 to the respectively lower parallel joists 18 and the upper parallel joists 24. It is understood, however, that upper and lower ends of each of the connecting struts 34 may be fixed to the respective lower parallel joists 18 and the upper parallel joists 24 with any other suitable fixing means, such as for example, welding.

The connecting struts 34 extend from the lower parallel joists 18 at an angle $\alpha 1$ that is of a sufficient arc to allow a user to position themselves in an upright and straight planking position when mounted on the exercise device 10, as will be described in more detail below. The angle $\alpha 1$ may therefore be an acute angle. Specifically, the angle $\alpha 1$ may be between approximately 60 degrees to 89 degrees, 65 degrees to 88 degrees, 70 degrees to 87 degrees, or 75 degrees to 85 degrees. The connecting struts 34 similarly extend from the upper parallel joists 18 at the angle $\alpha 1$, as depicted.

The support frame 16 includes a plank positioning plate 40 fixed to and extending between the connecting struts 34 of the support frame 16. The plank positioning plate 40 may additionally be fixed to at least one of the at least one supporting transverse joists 36 for additional support of the plank positioning plate 40. For example, as depicted, the plank positioning plate 40 is fixed to the connecting struts 34 on respective side edges of the plank positioning plate 40 and is fixed to a lower one of two supporting transverse joists 36 on the support frame 16. The plank positioning plate 40 may have a relatively flat polygonal shape. For example, the plank positioning plate 40 may have a quadrilateral shape, such as a square or a rectangle. In this manner, the plank positioning plate 40 can securely affix to each of the connecting struts 34 along the entirety of the respective side edges of the plank positioning plate 40 and can securely affix to the at least one supporting transverse joist 36 along the entirety of a respective top edge of the plank positioning plate 40.

The support frame 16, including the connecting struts 34, the at least one supporting transverse joist 26 may be formed of tubular or angular steel members. The plank positioning plate 40 of the support frame 16 may be formed of a plate-like steel or aluminum member. It will be understood, however, that such materials and constructions should be considered merely exemplary and may be alternately substituted within a broad range of functional equivalents.

The exercise device 10 described herein is configured to assist a user in maintaining an appropriate vertical plank position when operating the exercise device 10. Specifically, in operation, the user mounts themselves on the exercise device 10 with assistance from the at least mounting bar 28, as previously described. The user then positions their body with the assistance of the at least one stabilizing bar 30 such that their forearms are positioned approximately at a 90 degree angle relative to their upper arms and are resting on the plurality of arm pads 32, while the user grasps the at least one stabilizing bar 30 with their hands. In this position, the user's feet naturally fall against the plank positioning plate 40 with the force of gravity. As the user's feet engage the plank positioning plate 40, the user is able to position their body along a generally straight line from the crown of their head to their heels, angled relative to the floor between approximately 85 degrees to approximately 75 degrees (referred to herein as a vertical plank position). The user can hold the vertical plank position for any duration of time, such as 30 seconds, or may choose to hold the vertical plank position for as long as possible, engaging their core musculature to do so. Unlike a free-style plank performed without any equipment, the use of the exercise device 10 described herein allows the user to maintain the vertical plank position without putting undesirable stress on the user's lower back.

Figure 4:
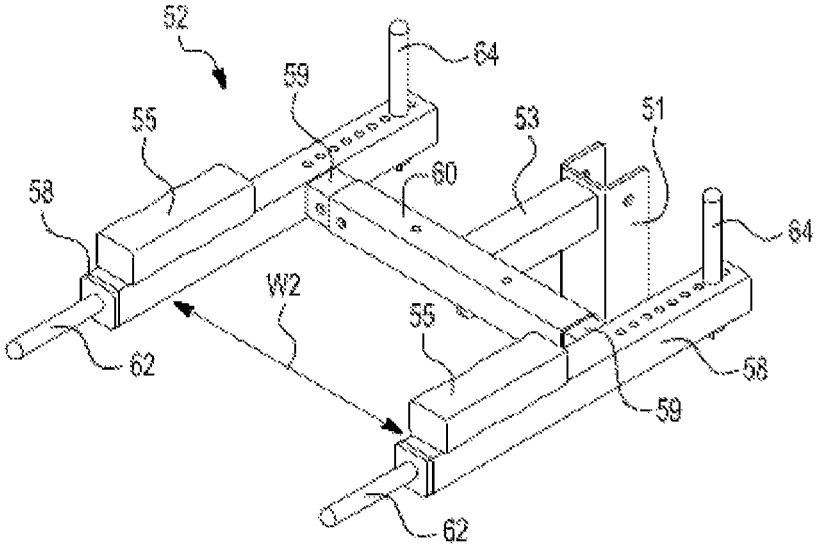
FIG. 4 is a perspective view of an upper platform of an exercise system.
Figure 5:
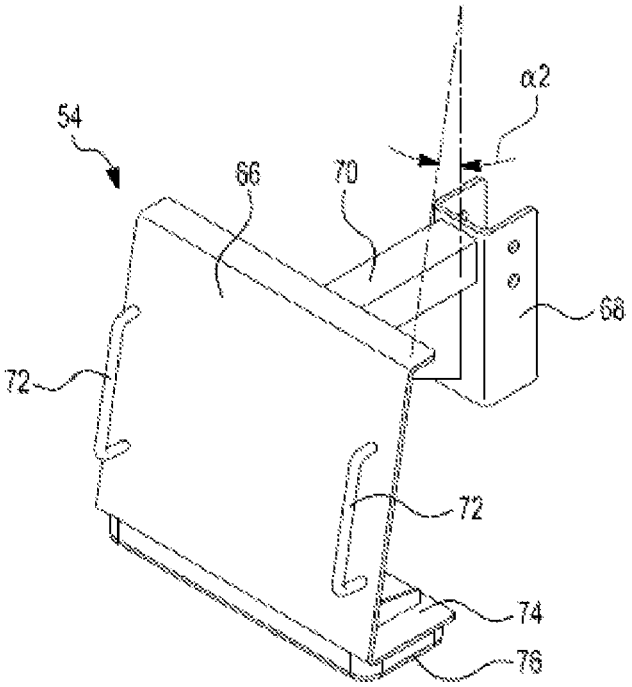
FIG. 5 is a perspective view of a lower plank positioning platform of the exercise system.
Figure 6:
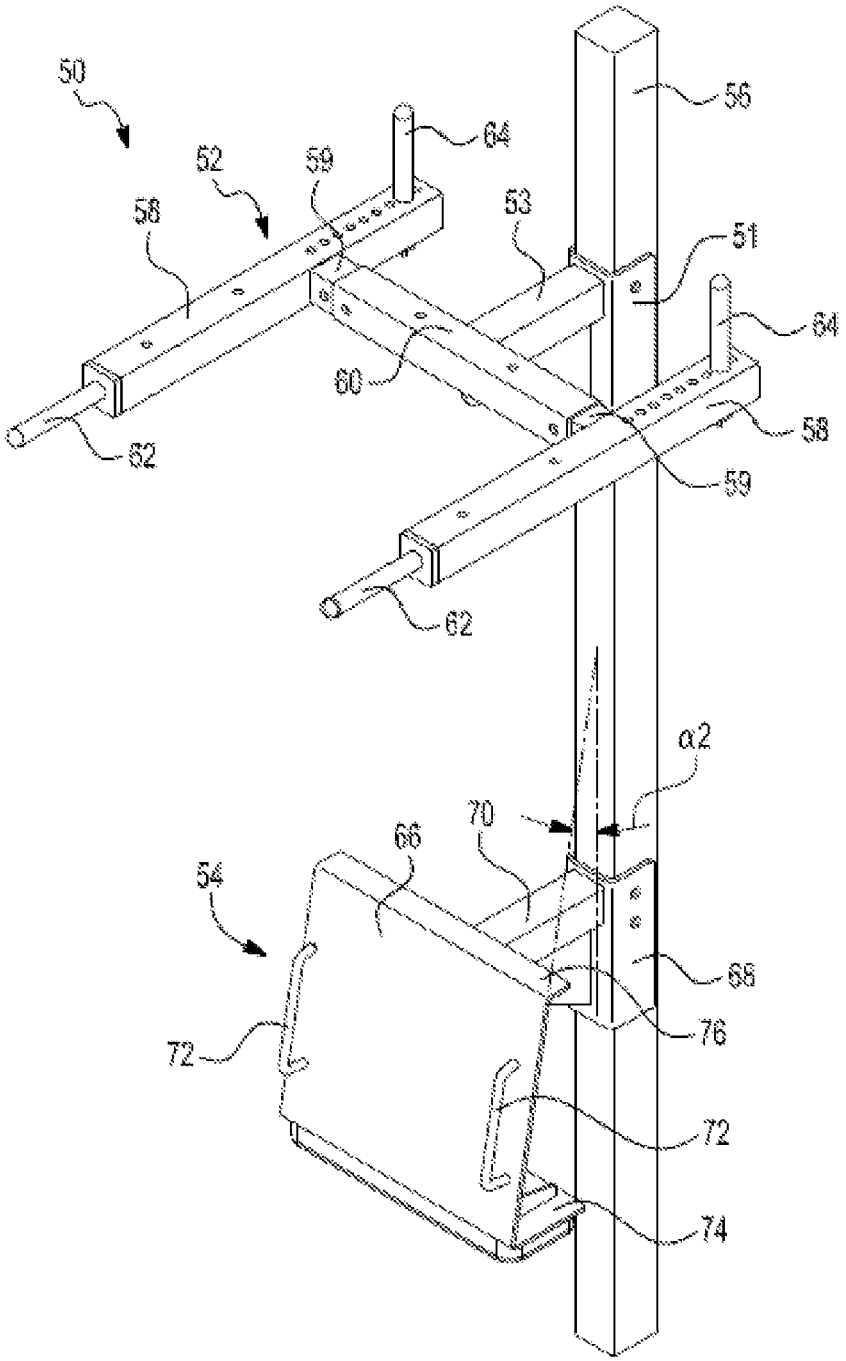
FIG. 6 is a perspective view of the exercise system including the upper platform and the lower plank positioning platform depicted in FIGS. 4 and 5, respectively.

Now turning to FIGS. 4-6, an exercise system 50 for facilitating a user in performing a vertical plank exercise is depicted. The exercise system 50 includes a discrete upper platform 52 and a discrete lower plank positioning platform 54, both of which are configured to be removably mounted onto a support frame 56, as depicted in FIG. 6. Specifically, the upper platform 52 and the lower plank positioning platform 54 are configured to be removably mounted onto the support frame 56 such that the upper platform 52 is positioned above the lower plank positioning platform 54, spaced apart from the lower plank positioning platform 54 a suitable distance so that the user's forearms can engage the upper platform 52 while the user's feet can engage the lower plank positioning platform 54 when the user is in the vertical plank position. The support frame 56 may be part of another exercise machine, for example a vertical frame member of a support frame of the other exercise machine. Alternatively, the support frame 56 may be a discrete stand-alone support frame 56. The support frame 56 may be formed of tubular or angular steel members. However, it is understood that such materials and constructions should be considered merely exemplary and may be alternately substituted within a broad range of functional equivalents.

Referring to FIG. 4 in particular, the upper platform 52 will be described in detail first. The upper platform 52 may be formed by a pair of upper parallel joists 58 adjustably spaced apart by a variable width W2. The variable width W2 may be, for example, in the range of 25.40 centimeters (10 inches) to 76.20 centimeters (30 inches), 30.48 centimeters (12 inches) to 68.58 centimeters (27 inches), or 38.10 centimeters (15 inches) to 60.96 centimeters (24 inches). The upper parallel joists 58 may be adjustably spaced apart with and supported by an upper transverse joist 60 adjustably fixed to and extending between the upper parallel joists 58. The upper parallel joists 58, for example, may each have a perpendicularly extending protrusion 59 configured to adjustably mate with the upper transverse joist 60 such that the perpendicularly extending protrusions 59 can slide in and out of the upper transverse joist 60. In this manner, a desired width W2 may be established and the perpendicularly extending protrusions 59 of the upper parallel joists 58 may be fixed to the upper transverse joist 60 accordingly. The perpendicularly extending protrusions 59 of the upper parallel joists 58 may be fixed to the upper transverse joist 60 with, for example, screws or bolts. The upper parallel joists 58 may have an overall length L2 to support a user's forearms during a typical operation of the exercise system 50, which will be described in greater detail below. The length L2 may be, for example, in the range of 25.40 centimeters (10 inches) to 101.60 centimeters (40 inches), 38.10 centimeters (15 inches) to 88.90 centimeters (35 inches), or 50.8 centimeters (20 inches) to 76.20 centimeters (30 inches). The upper parallel joists 58 and the upper transverse joist 60 are described herein as non-limiting examples, and it is understood that other supporting members other than joists may be used with the exercise device 10 described herein.

The upper platform 52 includes an upper mounting bracket 51 and an upper mounting bracket arm 53 configured to removably mount the upper platform 52 to the support frame 56. The upper mounting bracket arm 53 is fixed to and extends between the upper mounting bracket 51 and the upper transverse joist 60. The upper mounting bracket arm 53 may be fixed to the upper mounting bracket 51 and the upper transverse joist 60 by welding. However, it is understood that the upper mounting bracket arm 53 may be fixed to the upper mounting bracket 51 and the upper transverse joist 60 with any other suitable fixing means, such as screws or bolts. The upper mounting bracket 51 may be a U-shaped bracket configured to fit around and be removably fixed to the support frame 56. For example, the upper mounting bracket 51 may be removably fixed to the support frame 56 with screws or bolts.

The upper platform 52 may additionally include at least one mounting bar 62 and at least one stabilizing bar 64, each fixed to the upper platform 52 and configured to assist the user in mounting the exercise system 50 and stabilizing themselves on the exercise system 50, respectively. As depicted, the at least one mounting bar 62 includes two mounting bars 62, each fixed to one of the upper parallel joists 58 at a first end thereof and extending out from the end of each of the upper parallel joists 58. For example, the at least one mounting bar 62 may extend out from the first end of each of the upper parallel joists 58 such that they are cantilevered from the upper parallel joists 58 in a direction parallel to each of the upper parallel joists 58. In this way, a user can grasp the at least one mounting bar 62 to hoist themselves up onto the upper platform 52 of the exercise system 50 once the upper platform 52 has been mounted to the support frame 56 at an appropriate height. Once hoisted up, the user may grasp the at least one stabilizing bar 64 to position themselves appropriately on the exercise system 50 and stabilize themselves thereon. The at least one mounting bar 62 may additionally be configured to be used as grasping points for a user to perform various other exercises, such as tricep dips, on the exercise system 50.

As depicted, the at least one stabilizing bar 64 includes two stabilizing bars 64, each fixed to one of the upper parallel joists 58 at or near a second end thereof and extending out from each of the upper parallel joists 58. For example, the at least one stabilizing bar 64 may extend out from each of the upper parallel joists 58 at an angle that is not parallel to each of the upper parallel joists 58. As depicted, the at least one stabilizing bar 64 may extend out from each of the upper parallel joists 58 generally perpendicular to each of the upper parallel joists 58. In this way, the user can grasp the at least one stabilizing bar 64 to comfortably stabilize themselves on the exercise system 50 once mounted. The at least one stabilizing bar 64 may be repositionable on each of the upper parallel joists 58 so as to enable appropriate and comfortable grasping by a variety of users when they are mounted on the exercise system 50. Additionally, the at least one stabilizing bar 64 may be repositionable on another one of the upper parallel joists 58 so that more than one stabilizing bar 64 may be fixed to the same upper parallel joist 58. It is understood that the above-described positioning and orientation of the at least one mounting bar 62 and the at least one stabilizing bar 64 are described as non-limiting examples, and that other suitable arrangements may be suitable for the exercise system 50.

Figure 3:
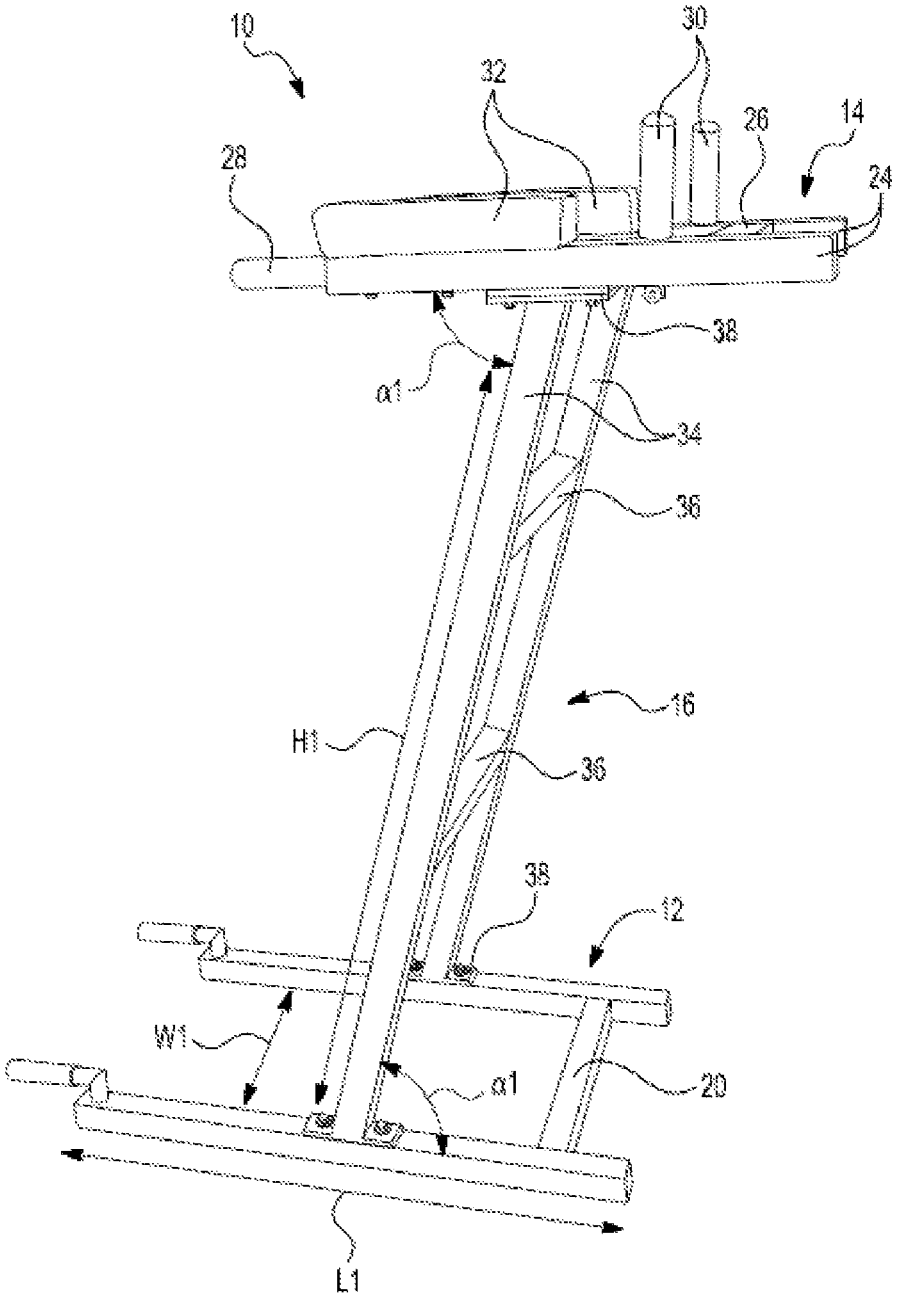
FIG. 3 is another perspective view of the exercise device of FIG. 2.

The upper platform 52 may additionally include a plurality of arm pads 55, each fixed to a respective one of the upper parallel joists 58 between the first and second end thereof. The plurality of arm pads 55 are similar to the arm pads 32 of the exercise device 10, described above with reference to FIGS. 2 and 3. For example, at least one of the plurality of arm pads 55 may be removably fixed to a respective one of the upper parallel joists 58 between the first and second end thereof such that they are repositionable thereon. Another one of the plurality of arm pads 55 may be fixed to the upper transverse joist 60. The plurality of arm pads 55 may be removably fixed to the respective upper parallel joists 58 and the upper transverse joist 60 with a hook and loop fastener, snaps, buttons, screws, bolts, or any other suitable removable fixing means. The arm pads 55 that are fixed to the upper parallel joists 58 may be disposed between a respective mounting bar 62 and stabilizing bar 64 of each of the upper parallel joists 58. In this way, once a user has mounted the exercise system 50 and is stabilized in the appropriate position by grasping the at least one stabilizing bar 64, the user's arms may rest comfortably on the plurality of arm pads 55 for supporting the user's weight on the exercise system 50. The arm pad 55 that is fixed to the upper transverse joist 60 is positioned so that when a user mounts the exercise system 50 and turns 90 degrees to the side, the user's arm may rest comfortably on the arm pad 55 on the upper transverse joist 60, facilitating the user in performing a side plank position. The plurality of arm pads 55 may be made of foam, fabric, leather, or any other suitable material configured to provide padding.

The upper platform 52, including the upper parallel joists 58, the upper transverse joist 60, the at least one mounting bar 62, and the at least one stabilizing bar 64 may be formed of tubular or angular steel members. However, it is understood that such materials and constructions should be considered merely exemplary and may be alternately substituted within a broad range of functional equivalents. The at least one mounting bar 62 and the at least one stabilizing bar 64 may additionally include a cover or coating on at least a part of the at least one mounting bar 62 and the at least one stabilizing bar 64, respectively. The cover or coating may be made of, for example, rubber, foam, fabric, leather, or any other suitable material configured to promote comfortable handling of the at least one mounting bar 62 and the at least one stabilizing bar 64.

Referring to FIG. 5, in particular, the lower plank positioning platform 54 will now be described in detail. The lower plank positioning platform 54 includes an adjustable plank positioning plate 66, a lower mounting bracket 68, and a lower mounting bracket arm 70. The lower mounting bracket 68 and the lower mounting bracket arm 70 are configured to removably and adjustably mount the lower plank positioning platform 54 to the support frame 56 below the mounted upper platform 52. Specifically, the lower plank positioning platform 54 is configured to be removably mounted to the support frame 56 such that it is spaced below the upper platform 52 at least a distance sufficient to allow the user's feet to engage the lower plank positioning platform 54 while the user's forearms engage the upper platform 52 when the user is in the vertical plank position. The lower mounting bracket arm 70 is fixed to and extends between the lower mounting bracket 68 and a back face of the plank positioning plate 66. The lower mounting bracket arm 70 may be fixed to the lower mounting bracket 68 and the back face of the plank positioning plate 66 by welding. However, it is understood that the lower mounting bracket 70 may be fixed to the lower mounting bracket 68 and the back face of the plank positioning plate 66 with any other suitable fixing means, such as screws or bolts. The lower mounting bracket 68 may be a U-shaped bracket similar to the upper mounting bracket 51, configured to fit around and be removably fixed to the support frame 56. For example, the lower mounting bracket 68 may be removably fixed to the support frame 56 with screws or bolts.

The lower mounting bracket arm 70 may be adjustable so as to adjust the spacing between the lower mounting bracket 68 and the back face of the plank positioning plate 66. For example, the lower mounting bracket arm 70 may be extended to space the plank positioning plate 66 further from the lower mounting bracket 68. The further that the plank positioning plate 66 is spaced from the lower mounting bracket 68, the more difficult the exercise will be for the user.

The plank positioning plate 66 may include at least one handling bar 72 fixed to a front face of the plank positioning plate 66 and configured to assist a user in handling or moving the lower plank positioning platform 54. As depicted, the at least one handling bar 72 includes two handling bars 72, each fixed to the front face of the plank positioning plate 66 at or near side edges thereof. However, it is understood that the at least one handling bar 72 may include one handling bar 72 or more than two handling bars 72 and may be fixed to any other part of the lower plank positioning platform 54. The at least one handling bar 72 may also be configured to be used as grasping points for a user to perform various other exercises with the exercise system 50.

The plank positioning plate 66 may have a relatively flat polygonal shape. For example, the plank positioning plate 66 may have a quadrilateral shape, such as a square or a rectangle. The plank positioning plate 66 is configured to extend at an angle $\alpha 2$, relative to the support frame 56, that is of a sufficient arc to allow a user to position themselves in an upright and straight planking position when mounted on the exercise system 50, as will be described in more detail below. The angle $\alpha 2$ may therefore be an acute angle. Specifically, the angle $\alpha 2$ may be between approximately 60 degrees to 89 degrees, 65 degrees to 88 degrees, 70 degrees to 87 degrees, or 75 degrees to 85 degrees.

The plank positioning plate 66 may include a flange 74 on a bottom edge thereof and the lower plank positioning platform 54 may additionally include a foot pad 76 positioned on a bottom face of the flange 74. The foot pad 76 is configured, for example, to provide cushioning for the user's heels while performing a Nordic curl exercise. Specifically, a user may use the lower plank positioning platform 54 to support the user's feet between the Nordic curl pad 76 and the floor as the user performs the Nordic curl exercise. The foot pad 76 may alternatively be used to assist the user in performing a variety of other exercises. The foot pad 76 may be removably fixed to the bottom face of the flange 74 or may be permanently fixed thereto.

The lower plank positioning platform 54, including the lower mounting bracket 68, the lower mounting bracket arm 70, and the at least one handling bar 72 may be formed of tubular or angular steel members. The plank positioning plate 66 of the lower plank positioning platform 54 may be formed of a plate-like steel or aluminum member. The foot pad 76 may be made of foam, fabric, leather, or any other suitable material configured to provide padding. It will be understood, however, that such materials and constructions should be considered merely exemplary and may be alternately substituted within a broad range of functional equivalents. The at least one handling bar 72 may include a cover or coating on at least a part of the at least one handling bar 72. The cover or coating may be made of, for example, rubber, foam, fabric, leather, or any other suitable material configured to promote comfortable handling of the at least one handling bar 72.

The exercise system 50 described herein is configured to assist a user in maintaining an appropriate vertical plank position when operating the exercise system 50. Specifically, in operation, the user mounts themselves on the exercise system 50 with assistance from the at least mounting bar 62 of the upper platform 52. The user then positions their body with the assistance of the at least one stabilizing bar 64 of the upper platform 52 such that their forearms are positioned approximately at a 90 degree angle relative to their upper arms and are resting on the plurality of arm pads, while the user grasps the at least one stabilizing bar 64 with their hands. In this position, the user's feet naturally fall against the plank positioning plate 66 of the lower plank positioning platform 54 with the force of gravity. As the user's feet engage the plank positioning plate 66, the user is able to position their body along a generally straight line from the crown of their head to their heels, angled relative to the floor between approximately 85 degrees to approximately 75 degrees (referred to herein as the vertical plank position). The user can hold the vertical plank position for any duration of time, such as 30 seconds, or may choose to hold the vertical plank position for as long as possible, engaging their core musculature to do so. Unlike a free-style plank performed without any equipment, the use of the exercise system 50 described herein allows the user to maintain the vertical plank position without putting undesirable stress on the user's lower back.

Figure 7:
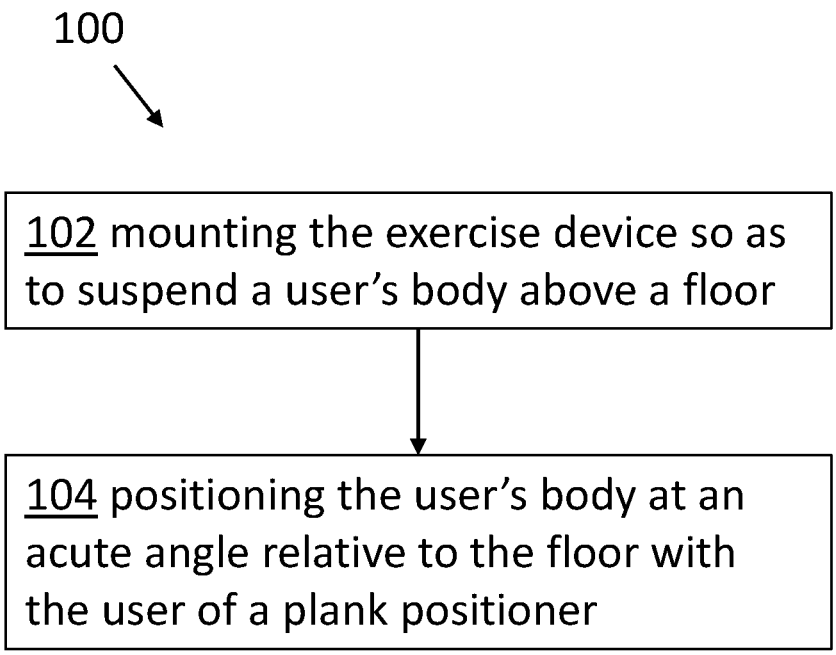
FIG. 7 is a flowchart of a method of performing a vertical plank exercise on an exercise device.

With reference to FIG. 7, a method 100 of performing a vertical plank exercise on an exercise device is depicted. The exercise device may be the same as the exercise device 1, 10 or the exercise system 50 described herein. The method includes a step 102 of mounting the exercise device so as to suspend a user's body above a floor. The step 102 of mounting the exercise device, for example, may include supporting at least one arm of the user on an upper support of the exercise device. For example, the user may mount themselves on the exercise device with assistance from at least mounting bar (such as the at least one mounting bar 28 or 62 described herein) of the upper support.

The method 100 then includes a step 104 of positioning the user's body at an acute angle relative to the floor with the use of a plank positioner. The step 104 of positioning the user's body may include positioning the user's body with the assistance of at least one stabilizing bar (such as the at least one stabilizing bar 30 or 64 described herein) such that their forearms are positioned approximately at a 90 degree angle relative to their upper arms and are resting on a plurality of arm pads (such as the plurality of arm pads 32 or 55 described herein), while the user grasps the at least one stabilizing bar with their hands. In this position, the user's legs will naturally fall against the plank positioner with the force of gravity. The step 104 of positioning the user's body therefore may also include supporting at least one leg of the user with the plank positioner. The plank positioner may be the same as the plank positioning plate 40 or 66 described herein. As the user's legs are supported by the plank positioner, the user's body is positioned along a generally straight line from the crown of their head to their heels, angled relative to the floor at the acute angle. The acute angle may be between approximately 60 degrees to 89 degrees, 65 degrees to 88 degrees, 70 degrees to 87 degrees, or 75 degrees to 85 degrees. The user can hold this vertical plank position for any duration of time, such as 30 seconds, or may choose to hold the vertical plank position for as long as possible, engaging their core musculature to do so. Unlike performing a free-style plank without any equipment, performing the method 100 described herein allows the user to maintain the vertical plank position without putting undesirable stress on the user's lower back. The user performing the method 100 is also depicted in FIG. 1.

Although the above disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. An exercise device for facilitating a user in holding a vertical plank position on the exercise device, the exercise device comprising:

a lower base configured to support the exercise device on the floor;

an upper support disposed above the lower base and configured to suspend the user on the exercise device above the floor; wherein the upper support is formed of a pair of upper parallel joists; and a plank positioning plate disposed between the lower base and the upper support and configured to support the user at an acute angle relative to the floor;

wherein the plank positioning plate is fixed relative to the pair of upper parallel joists of the upper support.

2. The exercise device according to claim 1, wherein the upper support formed of the pair of upper parallel joists includes at least one mounting bar fixed to the pair of upper parallel joists.

3. The exercise device according to claim 1, wherein the plank positioning plate is entirely vertically below the pair of upper parallel joists of the upper support.

4. The exercise device according to claim 1, wherein the plank positioning plate has greater height than depth.

5. An exercise device for facilitating a user in holding a vertical plank position on the exercise device, the exercise device comprising:

a lower base formed of a pair of lower parallel joists, an upper platform formed of a pair of upper parallel joists, and an angularly disposed upward support frame formed of a pair of parallel connecting struts fixed to and extending between the pair of lower parallel joists of the lower base and the pair of upper parallel joists of the upper platform, the angularly disposed upward support frame including a plank positioning plate fixed to and extending between the pair of parallel connecting struts;

wherein the plank positioning plate is entirely vertically below and fixed relative to the upper parallel joists; and wherein the plank positioning plate has greater height than depth.

6. The exercise device according to claim 5, wherein the pair of parallel connecting struts of the angularly disposed upward support frame extend from the pair of lower parallel joists and the pair of upper parallel joists at an angle in a range of 60 degrees to 89 degrees.

7. The exercise device according to claim 5, wherein the lower base includes at least one handling bar fixed to the pair of lower parallel joists.

8. The exercise device according to claim 5, wherein the upper platform includes at least one stabilizing bar fixed to the pair of upper parallel joists.

9. The exercise device according to claim 5, wherein the upper platform includes a plurality of arm pads, each fixed to a respective one of the pair of upper parallel joists.

10. The exercise device according to claim 5, wherein the lower base includes at least one lower transverse joist fixed to and extending between the pair of lower parallel joists.

11. The exercise device according to claim 5, wherein the upper platform includes at least one upper transverse joist fixed to and extending between the pair of upper parallel joists.

12. The exercise device according to claim 5, wherein the angularly disposed upward support frame includes at least one supporting transverse joist fixed to and extending between the pair of connecting struts.

13. An exercise system for facilitating a user in holding a vertical plank position on the exercise system, the exercise system comprising:

an upper platform configured to be removably mountable on a support frame, and a lower plank positioning platform configured to be removably mountable on the support frame below the upper platform;

wherein the upper platform includes a pair of upper parallel joists adjustably spaced apart by an upper transverse joist;

wherein the lower plank positioning platform includes a plank positioning plate and a mounting member fixable relative to the upper platform such that the plank positioning plate is entirely vertically below the pair of upper parallel joists; and wherein the plank positioning plate has greater height than depth.

14. The exercise system according to claim 13, wherein the lower plank positioning platform includes:

the plank positioning plate; and a mounting member comprising:

a lower mounting bracket, and a lower mounting bracket arm fixed to and extending between the lower mounting bracket and the plank positioning plate.

15. The exercise system according to claim 14, wherein the plank positioning plate includes at least one handling bar fixed to the plank positioning plate.

16. The exercise system according to claim 14, wherein the plank positioning plate is configured to be angled relative to the support frame at an angle in the range of 60 degrees to 89 degrees.

17. The exercise system according to claim 14, wherein the plank positioning plate includes a flange at a bottom edge thereof, and the lower plank positioning platform includes a foot pad disposed on a bottom surface of the flange.

18. The exercise system according to claim 13, wherein the upper platform includes:

the pair of upper parallel joists adjustably spaced apart and supported by the upper transverse joist, an upper mounting bracket, and an upper mounting bracket arm fixed to and extending between the upper mounting bracket and the upper transverse joist.

19. The exercise system according to claim 18, wherein the upper platform includes:

at least one mounting bar fixed to the pair of upper parallel joists, and at least one stabilizing bar fixed to the pair of upper parallel joists.

20. The exercise system according to claim 18, wherein the upper platform includes a plurality of arm pads, each fixed to a respective one of the upper parallel joists.

* * * * *